US005312273A

United States Patent [19]

Andre et al.

[11] Patent Number: 5,312,273

[45] Date of Patent: May 17, 1994

[54] SHIELDED MODULAR JACK

[75] Inventors: Marcel D. Andre, Vert Saint Denis; Christophe Bouchan, Longjumeau; Pascal Grandcluade, Suresnes, all of France

[73] Assignee: Molex Incorporated, Lisle, Ill.

[21] Appl. No.: 88,300

[22] Filed: Jul. 6, 1993

[30] Foreign Application Priority Data

Aug. 11, 1992 [EP] European Pat. Off. ..... 92113642.0

[51] Int. Cl.[5] ..... H01R 13/00

[52] U.S. Cl. ..... 439/607; 439/676

[58] Field of Search ..... 439/607-610, 439/667

[56] References Cited

U.S. PATENT DOCUMENTS

| | | | |
|---|---|---|---|
| 4,725,241 | 2/1988 | Bertini et al. | 439/188 |
| 4,878,858 | 11/1989 | Dechelette | 439/607 |
| 4,959,626 | 9/1990 | Mouissie | 439/607 |
| 5,228,871 | 7/1993 | Goodman | 439/607 |
| 5,228,872 | 7/1993 | Liu | 439/607 |

*Primary Examiner*—Joseph H. McGlynn
*Attorney, Agent, or Firm*—A. A. Tirva

[57] ABSTRACT

A shielded modular jack is provided for interfacing a modular plug with a printed circuit board. The plug has an external conductive shield, and the jack includes a dielectric housing having a plug-receiving cavity. A plurality of terminals are mounted on the housing with resilient cantilevered contact arms extending into the cavity for engaging respective contacts of the plug when the plug is inserted into the cavity. An electrically conductive shield includes a pair of electrically isolated shield portions each having a board contact projecting beyond the housing for contacting a circuit trace on the printed circuit board, along with a shield wall disposed in the plug-receiving cavity for electrically contacting the shield on the plug when the plug is inserted into the cavity. The inserted plug electrically couples the shield portions and, thereby, establishes electrical continuity between the circuit traces on the printed circuit board. A shunt module is inserted into a second cavity part in the jack housing. The shunt module includes a dielectric housing mounting at least a pair of normally closed shunt terminals each including a board contact projecting beyond the housing for contacting a circuit trace on the printed circuit board. One of the shunt terminals has an actuating portion projecting into the plug-receiving cavity for engagement by the plug to open the normally closed shunt terminals when the plug is inserted into the plug-receiving cavity.

9 Claims, 4 Drawing Sheets

SHIELDED MODULAR JACK

FIELD OF THE INVENTION

This invention generally relates to the art of electrical connectors and, particularly, to a modular jack for interfacing a modular plug with a printed circuit board or the like.

BACKGROUND OF THE INVENTION

Modular jacks are used in a variety of applications, such as telephone jacks for interfacing a modular telephone plug with a printed circuit board. Most modular jacks are fairly conventional in that they include a housing molded from an insulating material, with a plug receiving cavity opening at a front mating face of the housing, and with a row of cantilevered spring contact arms anchored in the housing and projecting into the cavity such that the contact arms are resiliently engaged by respective contacts of a complementary plug when it is inserted through the opening into the cavity. In many electronic environments, the jack typically is mounted to a printed circuit board, panel or the like, with the spring contact arms being portions of terminals which are electrically connected to conductive areas or circuit traces on the circuit board or panel.

In some applications, it is necessary to shield the interfacing circuits to avoid generating electromagnetic interference, and/or to avoid being impacted by ambient electromagnetic interference. For instance, the cables leading to the plug may include an electrically conductive shield, such as a braid or a foil, extending around the conductors of the cable. The plug itself will include an electrically conductive shield extending thereabout and in electrical contact with the shield of the cable. The jack, itself, will include its own shield which will be grounded to the board on which the jack is mounted. The jack shield typically is mounted on the outside or on the inside of the housing, and solder tails or other board contact means are provided for connecting the shield to grounds on the printed circuit board.

In other modular jack applications, it is necessary to detect the introduction of a plug into the cavity of the modular jack. Heretofore, such detection often has been accomplished by using one of the resilient contact arms or terminals of the modular jack. However, with such a system, that particular terminal is not available for any other use.

In still further applications, the modular jack may be coupled to a "shared line", whereby an additional, normally closed, circuit is required so that the circuit can be opened by the insertion of a plug into the jack to prevent use of the shared line by other jack and plug interfaces. Heretofore, such systems have required additional jack components, integrally molded cams or the like for effecting opening or breaking of the normally closed circuit.

This invention is directed to providing a modular shielded jack system which performs all of the above functions for the various stated applications in a very simply manner, without losing any of the jack circuits (i.e. to detect insertion of a plug) and without requiring extra components, cams and the like on the jack housing for opening normally closed circuits.

SUMMARY OF THE INVENTION

An object, therefore, of the invention is to provide a new and improved modular shielded jack for interfacing a modular plug with a printed circuit board, including means for detecting the insertion of the plug into the jack as well as means for opening a normally closed circuit when the plug is inserted into the jack.

In the exemplary embodiment of the invention, the modular shielded jack includes a dielectric housing having a plug-receiving cavity. A plurality of terminals are mounted or anchored on the housing with cantilevered resilient contact arms extending into the cavity for engaging respective contacts of the plug when the plug is inserted into the cavity. The invention contemplates an electrically conductive shield means on the jack and including at least a pair of electrically isolated shield portions. Each shield portion has a board contact projecting beyond the housing for contacting a circuit trace on the printed circuit board and a shield wall disposed in the plug-receiving cavity for electrically contacting a shield on the plug when the plug is inserted into the cavity. Therefore, insertion of the plug electrically couples the shield portions and, thereby, establishes electrical continuity between the circuit traces on the printed circuit board.

As disclosed herein, the cavity in the jack housing is generally rectangularly shaped. Each shield portion includes a side wall and top and bottom wall portions combining to define a generally rectangular shield means about a substantial area of the cavity. The side walls of the shield portions include resilient fingers projecting into the cavity for engaging the shield on the plug when the plug is inserted into the cavity.

The invention also contemplates a system whereby insertion of the plug into the jack is effective to open a normally closed circuit, such as with the jack being coupled to a "shared line". Specifically, the plug-receiving cavity is part of a cavity means in the jack housing which includes a second cavity part. A shunt module is insertable into the second cavity part. The shunt module includes a dielectric housing mounting at least a pair of normally closed shunt terminals, each terminal including a board contact projecting beyond the housing for contacting a circuit trace on the printed circuit board. One of the shunt terminals has an actuating portion projecting into the plug-receiving cavity for engagement by the plug to open the normally closed shunt terminals when the plug is inserted into the plug-receiving cavity. As disclosed herein, the dielectric housing of the shunt module is a unitarily molded component which is overmolded about portions of the shunt terminals to mount the shunt terminals therein.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
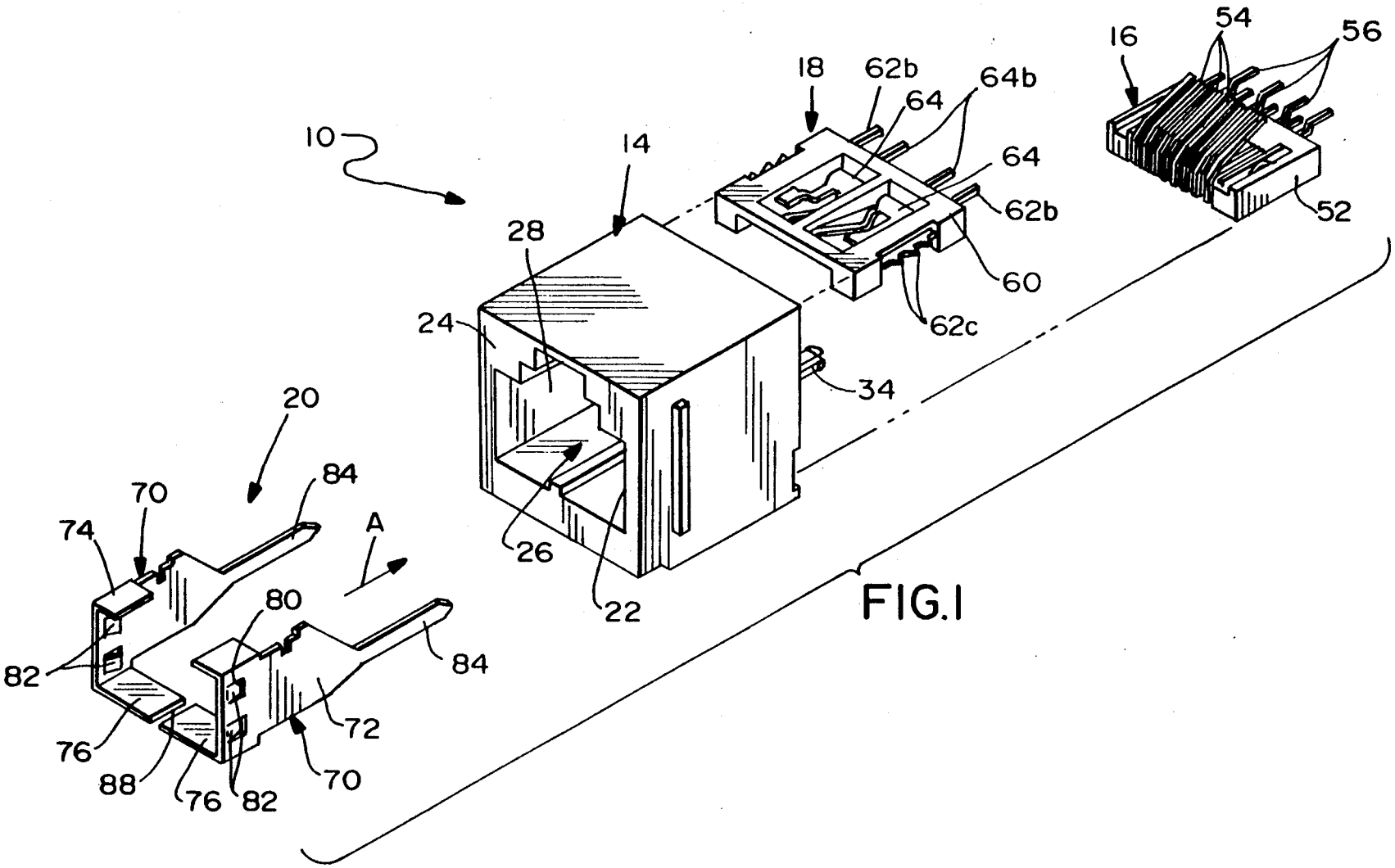
FIG. 1 is an exploded perspective view of the components of the modular shielded jack of the present invention.

Referring to the drawings in greater detail, and first to FIG. 1, the invention is embodied in a modular shielded jack or jack assembly, generally designated 10, for interfacing with a shielded modular plug, generally designated 12 in FIG. 2 and which will be described in greater detail hereinafter. Suffice it to say at this point, modular shielded jack 10 is provided for interfacing modular shielded plug 12 with a printed circuit board.

Generally, modular shielded jack 10 is shown in FIG. 1 to include a one-piece dielectric housing, generally designated 14, unitarily molded of plastic material or the like. The housing encases a signal module, generally designated 16, a shunt module, generally designated 18, and an electrically conductive shield means, generally designated 20. Housing 14 has an opening 22 in a mating face 24 and through which modular shielded plug 12 is inserted in the direction of arrow "A" into a cavity means, generally designated 26, within the housing. As will be explained in greater detail hereinafter, insertion of modular shielded plug 12 into cavity means 26 of jack housing 14 is effective to (a) electrically couple the plug to signal module 16, (b) close a circuit through shield means 20 and (c) open at least one normally closed circuit through shunt module 18.

Figure 2:
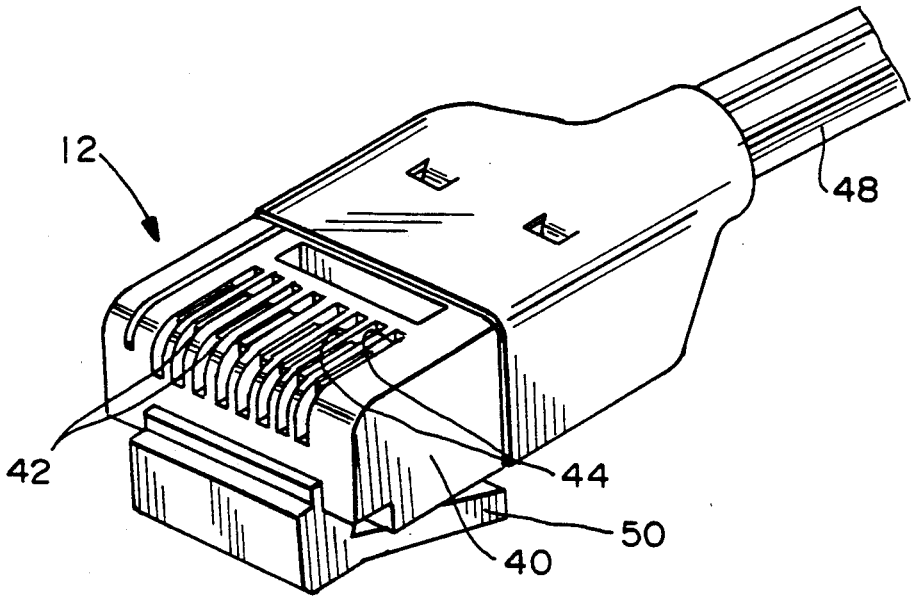
FIG. 2 is a perspective view of a typical shielded plug for insertion into the jack of FIG. 1.
Figure 3:
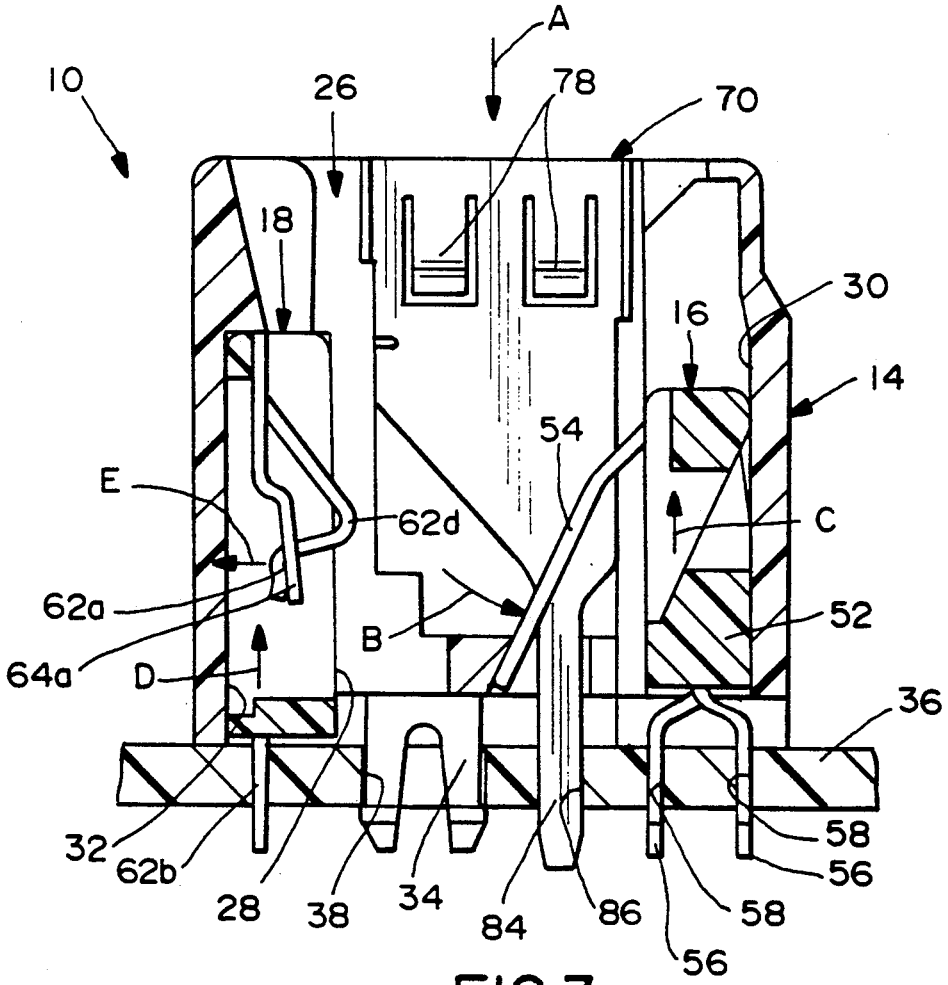
FIG. 3 is an axial section through the modular jack, in assembled condition and as the jack would be mounted to a printed circuit board.
Figure 4:
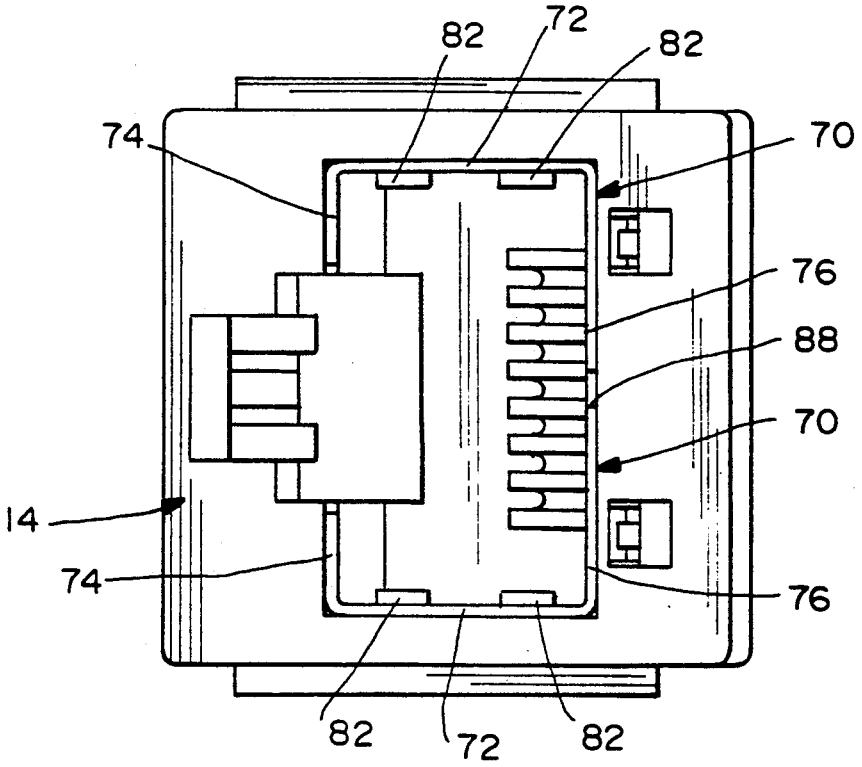
FIG. 4 is a top plan view of the jack housing with the shield portions assembled thereinto.

Referring to FIGS. 3 and 4 in conjunction with FIG. 1, cavity means 26 in jack housing 14 has three portions or parts, namely: a plug receiving cavity 28, a signal module-receiving cavity 30 and a shunt module-receiving cavity 32, all of which are best seen in FIG. 3. The housing includes one or more bifurcated mounting pegs 34 for mounting the jack housing to a printed circuit board 36 by inserting the mounting pegs through mounting holes 38 in the board. Therefore, in the configuration shown, the modular jack is a "top entry" jack, in that modular shielded plug 12 (FIG. 2) is inserted into the jack downwardly in the direction of arrow "A". Lastly, plug-receiving cavity 28 also receives shield means 20, as described hereinafter.

Before proceeding with a description of signal module 16, shunt module 18 and shield means 20, reference is made to FIG. 2 for a brief description of modular shielded plug 12. As stated above, the modular shielded plug is typical to the extent that it includes a dielectric housing 40 mounting a plurality of terminals which include plug contacts 42 disposed respectively within discrete slots 44 in the housing. The housing is dimensioned for insertion into plug-receiving cavity 28 of jack housing 14. The plug further includes an external metallic shield 46 which is in electrical contact with a shield of a shielded cable 48. In particular, the cable includes a plurality of leads which are electrically connected to the terminals having plug contacts 42. The cable further includes an electrically conductive shield, such as a braid or a foil, extending around the signal carrying leads or conductors of the cable. External metallic shield 46 is electrically coupled to the shield of the cable. Lastly, housing 40 of the plug includes a pair of side, integrally molded actuating tabs 50 which are effective to open the shunt module circuits, as described hereinafter, when the plug is inserted into jack housing 14. When the plug is inserted into the jack housing, plug contacts 42 engage the terminals on signal module 16, again as described hereinafter. It should be noted that modular shielded plug 12 is shown in FIG. 2 "upside-down" in relation to the orientation of the plug for insertion into jack housing 14 in the direction of arrow "A", as the jack housing is oriented in FIG. 1. This has been done to show the plug contacts 42 being exposed at one side of the shielded plug.

Referring back to FIGS. 3 and 4 in conjunction with FIG. 1, signal module 16 includes a one-piece die-electric housing 52 integrally molded of plastic or like material. The housing mounts a plurality of terminals, each terminal including a cantilevered resilient contact arm 54 which projects into plug-receiving cavity 28 as best seen in FIG. 3. Contact arms 54 are effective to engage, respectively, plug contacts 42 when the plug is inserted into plug-receiving 28, with the plug contacts biasing the resilient cantilevered contact arms in the direction of arrow "B" (FIG. 3). The terminals of signal module 16 also include circuit board contacts in the form of solder tails 56 which project beyond jack housing 14 for insertion into appropriate holes 58 (FIG. 3) in printed circuit board 36 for soldering to circuit traces in the holes or on the board. As seen best in FIG. 3, signal module 16 is assembled within signal module-receiving cavity 30 of jack housing 14 in the direction of arrow "C".

Figure 6:
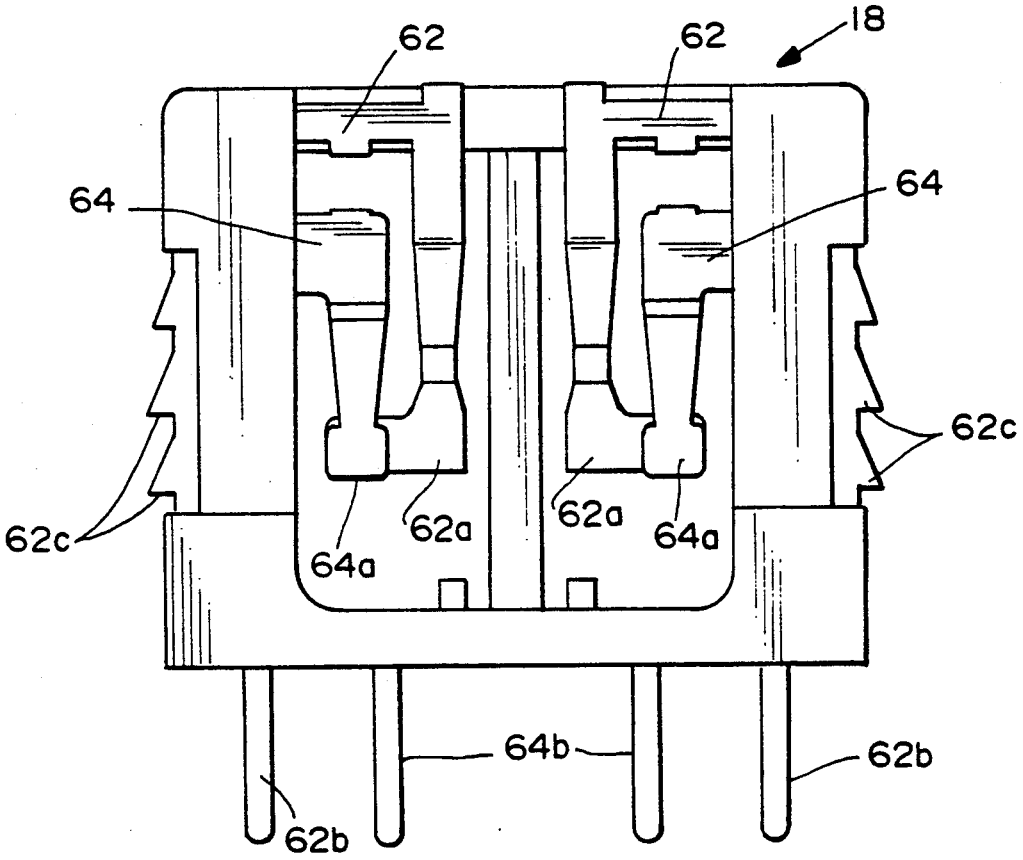
FIG. 6 is a side view of the shunt module of the modular jack.

As seen best in FIGS. 1, 3 and 6, shunt module 18 includes a one-piece dielectric housing 60 unitarily molded of plastic or like material. The housing mounts two pairs of shunt terminals 62 and 64 which have contact portions 62*a* and 64*a*, respectively, normally spring-loaded into closed condition as shown in FIG. 3. It should be noted that the shunt module is shown in FIG. 6 "upside-down" versus the depiction in FIG. 1. Shunt terminals 62 and 64 also include board contacts in the form of solder tails 62*b* and 64*b*, respectively, projecting beyond housing 60, although portions of the terminals embedded within the housing are not visible in FIGS. 1 and 6. Shunt terminals 62 have serrations 62*c* projecting outwardly of the sides of housing 60 for biting into the plastic material of shunt module-receiving cavity 32 of jack housing 14 to lock the shunt module within the cavity, after the shunt module is inserted into the cavity in the direction of arrow "D" (FIG. 3). Lastly, shunt terminals 62 have contact arms 62*d* which project beyond the shunt housing into plug-receiving cavity 28 in the insertion path of plug 12, as best seen in FIG. 3.

Therefore, when the plug is inserted into the jack housing, the plug housing engages contact arms 62*d* of shunt terminals 62 and biases contact portions 62*a* away from contact portions 64*a* in the direction of arrow "E" (FIG. 3) to open the circuits through the normally closed contact portions 62*a*,64*a* and thereby open the circuits on printed circuit board 36 through solder tails 62*b* and 64*b*. Consequently, in applications where modular jack 10 is coupled on the printed circuit board in a "shared line", appropriate circuits on the printed circuit board are opened by insertion of the plug into the jack to prevent another plug/jack from being used in the shared line.

It is contemplated that dielectric housing 60 of the shunt module be fabricated as a unitarily molded component which is overmolded about portions of the shunt terminals to mount the shunt terminals therein while exposing contact portions 62*a* and 64*a*, solder tails 62*b* and 64*b*, serrations 62*c* and contact arms 62*d* exteriorly of the overmolded housing. This is best seen in FIG. 6.

The invention also contemplates that shield means 20 be employed as a means for detecting the presence or insertion of a plug into the modular jack. More particularly, shield means 20 is provided by a pair of electrically isolated shield portions 70 which, as shown in FIG. 1, are mirror images of each other. Each shield portion includes a side wall 72 and top and bottom wall portions 74 and 76, respectively. Plug-receiving cavity 28 can be seen in FIG. 1 as being generally rectangular. Therefore, the side walls and top and bottom wall portions of shield portions 70 combine to define a generally rectangular shield means about a substantial area of the cavity. The shield portions are assembled within jack housing 14 in the same direction as insertion of the modular plug, i.e. in the direction of arrow "A". The side walls of the plug-receiving cavity have integrally molded, inwardly projecting latch bosses 78 which are inwardly ramped. Side walls 70 of the shield portions have cutouts 80 which snap behind the latch bosses when the shield portions are inserted into the jack housing. The shield portions are fabricated of stamped and formed sheet metal material, and the area of metal within cutouts 80 are bent or cantilevered inwardly to define resilient fingers 82. The fingers should project into the plug-receiving cavity slightly further than the thickness of latch bosses 78 to provide an amount of resiliency upon engagement with the inserted modular plug.

Still referring to shield means 20 in FIG. 1, each shield portion 70 includes a board contact in the form of a solder tail 84 whereby, when the shield portions are assembled within jack housing 14, the solder tails project beyond the housing as seen best in FIG. 3, for insertion through appropriate holes 86 in printed circuit board 36 for soldering to circuit traces in the holes or on the board. Now, referring back to FIG. 1, it can be seen that shield portions 70 are electrically isolated from each other by a spacing, indicated at 88. Therefore, the circuit through the circuit traces to which solder tails 84 are soldered is a normally open circuit. When modular plug 12 is inserted into jack housing 14, external shield 46 of the plug engages shield portions 70, particularly spring fingers 82 thereof, and thereby closes a circuit through the shield portions. This circuit can be used as a detection means for detecting and indicating the presence or insertion of a plug into the modular jack.

Figure 5:
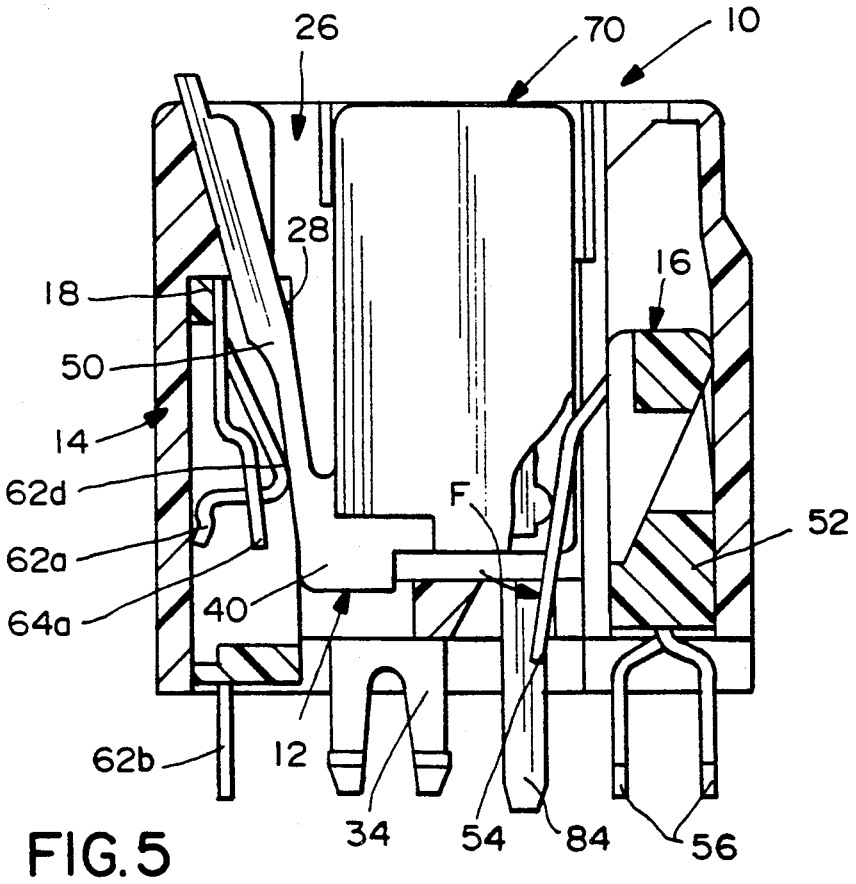
FIG. 5 is an axial section similar to that of FIG. 3, with the plug inserted into the jack.

Lastly, referring to FIG. 5, modular shielded plug 12 is shown as having been inserted into plug-receiving cavity 28 of jack housing 14. It can be seen that resilient cantilevered contact arms 54 of signal module 16 have been biased in the direction of arrow "F". This is effected by engagement of the contact arms with plug contacts 42 (FIG. 2). It also can be seen that the plug housing 40 has engaged contact arms 62*d* of shunt module 18 to separate or open the normally closed shunt contacts 62*a* and 64*a*. Although not as clearly visible in FIG. 5, external shield 46 of the plug has engaged resilient fingers 78 of shield portions 70 to close a circuit through the shield portions.

All of these functions of electrically coupling the plug terminals to the signal module terminals, opening the circuit(s) through the shunt module and closing the circuit through the shield means of the jack are accomplished in a very simple and efficient manner. The modular construction of the jack enables the signal module and the shunt module to be independently fabricated and assembled into the jack housing. For instance, in an application wherein the shunt module is not necessary, the shunt module simply can be eliminated and the only difference is that the jack housing was molded with a cavity portion which now is not used. Likewise, shield means 20 could be a single or unitary shield, rather than including electrically isolated shield portions, and there would have to be no modifications whatsoever of the jack housing itself. The modular concepts of shielded jack 10 can be seen to have many advantages.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a shielded modular jack for interfacing a modular plug with a printed circuit board, the plug having an external conductive shield thereon, and the jack including a dielectric housing having a plug-receiving cavity, a plurality of terminals mounted on the housing with resilient cantilevered contact arms extending into the cavity for engaging respective contacts of the plug when the plug is inserted into the cavity, wherein the improvement comprises an electrically conductive shield means including at least a pair of electrical isolated shield portions each having a board contact projecting beyond the housing for contacting a circuit trace on the printed circuit board and a shield wall disposed in the plug-receiving cavity of the housing for electrically contacting the shield on the plug when the plug is inserted into the cavity, whereby insertion of the plug into the cavity electrically couples the shield portions and, thereby, establishes electrical continuity between the circuit traces on the printed circuit board.

2. In a shielded modular jack as set forth in claim 1, wherein said plug-receiving cavity comprises part of a cavity means in the housing and which includes a second cavity part, and including a signal module insertable into the second cavity part, the signal module comprising a dielectric housing mounting said plurality of terminals with the resilient cantilevered contact arms thereof projecting from the second cavity part into the plug-receiving cavity.

3. In a shielded modular jack as set forth in claim 1, wherein said cavity is generally rectangularly shaped and each of said shield portions includes a side wall and top and bottom wall portions combining to define a generally rectangular shield means about a substantial area of the cavity.

4. In a shielded modular jack as set forth in claim 3, wherein the side walls of the shield portions include resilient fingers projecting into the cavity for engaging the shield on the plug when the plug is inserted into the cavity.

5. In a shielded modular jack as set forth in claim 1, wherein said plug-receiving cavity comprises part of a cavity means in the housing and which includes a second cavity part, and including a shunt module insertable into the second cavity part, the shunt module comprising a dielectric housing mounting at least a pair of normally closed shunt terminals each including a board contact projecting beyond the housing for contacting a circuit trace on the printed circuit board, and one of the shunt terminals having an actuating portion projecting into the plug-receiving cavity for engagement by the plug to open the normally closed shunt terminals when the plug is inserted into the plug-receiving cavity.

6. In a shielded modular jack as set forth in claim 5, wherein the dielectric housing of said shunt module comprises a unitarily molded component which is overmolded about portions of the shunt terminals to mount the shunt terminals therein.

7. In a modular jack for interfacing a modular plug with a printed circuit board, the jack including a dielectric housing having cavity means defining a plug-receiving cavity portion, a plurality of terminals mounted on the housing with resilient cantilevered contact arms extending into the plug-receiving cavity portion for engaging respective contacts of the plug when the plug is inserted into the plug-receiving cavity portion, wherein the improvement comprises said cavity means including a second cavity portion, and a shunt module insertable into the second cavity portion, the shunt module including a dielectric housing mounting at least a pair of normally closed shunt terminals each including a board contact projecting beyond the housing for contacting a circuit trace on the printed circuit board, and one of the shunt terminals having an actuating portion projecting from the second cavity portion into the plug-receiving cavity portion for engagement by the plug to open the normally closed shunt terminals when the plug is inserted into the plug receiving cavity portion.

8. In a modular jack as set forth in claim 7, wherein the dielectric housing of said shunt module comprises a unitarily molded component which is overmolded about portions of the shunt terminals to mount the shunt terminals therein.

9. In a modular jack as set forth in claim 7, wherein said cavity means include a third cavity portion, and including a signal module insertable into the third cavity portion, the signal module comprising a dielectric housing mounting said plurality of terminals with the resilient cantilevered contact arms thereof projecting from the third cavity portion into the plug-receiving cavity portion.

* * * * *